US010166462B2

(12) United States Patent
Friesen et al.

(10) Patent No.: US 10,166,462 B2
(45) Date of Patent: Jan. 1, 2019

(54) METHOD OF PLAYING A GAME TICKET WITH A FOLDING ACTION

(71) Applicant: Pollard Banknote Limited, Winnipeg (CA)

(72) Inventors: Valerie Friesen, Winnipeg (CA); Nancy Bettcher, Winnipeg (CA); Lyle Scrymgeour, Oakbank (CA)

(73) Assignee: Pollard Banknote Limited, Winnipeg, MB (CA)

( * ) Notice: Subject to any disclaimer, the term of this patent is extended or adjusted under 35 U.S.C. 154(b) by 649 days.

(21) Appl. No.: 14/683,355

(22) Filed: Apr. 10, 2015

(65) Prior Publication Data

US 2015/0306492 A1 Oct. 29, 2015

Related U.S. Application Data

(62) Division of application No. 13/415,219, filed on Mar. 8, 2012.

(60) Provisional application No. 61/451,421, filed on Mar. 10, 2011.

(51) Int. Cl.
*G07F 17/32* (2006.01)
*A63F 3/06* (2006.01)

(52) U.S. Cl.
CPC ..... *A63F 3/0665* (2013.01); *A63F 3/0655* (2013.01); *G07F 17/32* (2013.01); *G07F 17/329* (2013.01)

(58) Field of Classification Search
CPC ..... A63F 3/0665; G07F 17/32; G07F 17/329
USPC ..... 281/2, 38; 283/67, 72, 94, 98, 100, 101, 283/901, 903
See application file for complete search history.

(56) References Cited

U.S. PATENT DOCUMENTS

| | | | | |
|---|---|---|---|---|
| 4,778,153 | A * | 10/1988 | Bachman | A63F 3/0665 283/101 |
| 5,193,815 | A * | 3/1993 | Pollard | A63F 3/062 283/901 |
| 5,560,610 | A | 10/1996 | Behm et al. | |
| 6,234,477 | B1 | 5/2001 | Friesen et al. | |
| 7,472,926 | B2 | 1/2009 | Friesen et al. | |
| 2002/0093188 | A1 | 7/2002 | Downes et al. | |
| 2008/0191460 | A1 | 8/2008 | Blank | |

(Continued)

FOREIGN PATENT DOCUMENTS

| | | |
|---|---|---|
| WO | 0103784 | 1/2001 |
| WO | 00123054 | 1/2001 |
| WO | 2004078292 | 9/2004 |

(Continued)

*Primary Examiner* — Justin V Lewis
(74) *Attorney, Agent, or Firm* — Adrian D. Battison; Ade & Company Inc; Kyle R. Satterthwait

(57) ABSTRACT

A game ticket printed on a ticket substrate includes a first surface portion with a first game play area thereon and a second surface portion of the substrate with a second game play area. Each of said first and second game play areas contains game play symbols printed on the game play area covered by a scratch-off material. The ticket can be modified by folding or by separating portions so as to provide movement of the second game play area relative to said game play information to allow playing by the player of the game symbols on the second play area. The ticket includes a single prize validated by a single bar code and the result of a combination of both the first and second aspects of the play.

24 Claims, 8 Drawing Sheets

(56) References Cited

U.S. PATENT DOCUMENTS

2009/0309352 A1 12/2009 Walker et al.

FOREIGN PATENT DOCUMENTS

| | | |
|---|---|---|
| WO | 2005056135 | 6/2005 |
| WO | 2009063351 | 5/2009 |

* cited by examiner

| | | |
|---|---|---|
| 804 | 26075 | 397 |
| 754 | 05861 | 953 |

FIG.3B

| | | |
|---|---|---|
| 963 | 26075 | 191 |
| 832 | 05861 | 897 |

FIG.3C

METHOD OF PLAYING A GAME TICKET WITH A FOLDING ACTION

This application claims the benefit under 35 USC 119(e) of Provisional Application 61/451421 filed Mar. 10, 2011.

This application is a divisional application from application Ser. No. 13/415219 filed Mar. 8, 2012.

The present invention relates generally to the field of game or lottery tickets and more particularly to method of playing a ticket assembly which provides an enhanced play action for the player.

BACKGROUND OF THE INVENTION

Lottery tickets are well known and widely sold and typically comprised of a sheet material of paper or card stock on which is printed lottery information and various indicia for the playing of one or more games. Many such games are instant win type games where the player can play the game or games by carrying out various functions, for example, opening pull tabs on a break-open ticket. Such tickets are also known variously as pull-tabs, pickle cards, jar tickets, hard cards and charitable gaming tickets.

In U.S. Pat. No. 6,234,477 assigned to the present assignee and issued May 22, 2001 is disclosed a construction of lottery ticket which utilizes variable image printing techniques in combination with lamination of two substrate sheets together to form what is initially a common pouch construction with the game indicia on the inside surface where the sheets can be separated, each from the other, to form in effect two separate tickets.

In U.S. Pat. No. 7,472,926 assigned to the present assignee and issued Jan. 6, 2009 is disclosed a game ticket construction formed by laminating two substrate sheets by a band of adhesive between the sheets across a center line so as to form an initially flat construction which can be folded into a four page eight surface booklet. A plurality of different games, each defined by game indicia some or all of which are covered by a scratch-off layer are printed, one onto each of the six surfaces except the first and last which carry promotional material.

Instant ticket games typically utilize an opaque scratch-off over printed game data so that the player can remove the scratch-off to expose the game data to allow the player to determine from the data whether the game data satisfies the criteria of the game to be a winning ticket and if so how much is the prize value. Attention has been given over many years to try to improve the play action for the player to try to remove the impression that the game is merely predetermined. Many new game formats have been developed to this effect.

Some games also use a translucent scratch-off material to mark the game play area of the ticket, for example in a bingo or cross-word format, by the player removing the translucent scratch-off from covered data so that the marked data where the scratch-off is removed has a different color appearance from that which has not been removed. However the game still relies on game play data which is covered by an opaque scratch-off layer to be exposed and played on the game play area.

SUMMARY OF THE INVENTION

It is one object of the invention to provide a ticket assembly which provides an enhanced play action for the player.

According to one aspect of the invention there is provided a game ticket comprising:

a ticket substrate;

a first surface portion and a second surface portion of the substrate;

a first game play area printed on the first surface portion on a front surface of the ticket substrate;

a second game play area printed on the second surface portion of the ticket substrate;

each of said first and second game play areas containing game play symbols printed on the game play area;

each of said first and second game play areas containing a scratch-off material covering at least a part of the game play area which can be removed by the player for playing of the game by the player;

game information printed on the substrate;

the first game play area being arranged relative to said game play information to allow playing by the player of the game symbols on the first play area;

the ticket substrate being arranged to provide movement of the second game play area relative to said game play information to allow playing by the player of the game symbols on the second play area.

In one arrangement, the second game play area is moved by folding of the ticket substrate. Alternatively it is possible to remove one piece of the ticket from another and to juxtapose the two pieces in a different arrangement.

When folding, the second game play area can be provided on the rear surface of the ticket substrate and is moved by folding of the ticket substrate to move the rear surface to align with a portion of the front surface.

Alternatively the second game play area is located on the front surface and is moved by folding of the ticket substrate to move the second game play area to align with a portion of the front surface by an accordion fold.

Preferably the second game play area is moved to lie along side at least part of the first game play area and/or at least part of the game information.

In one arrangement a folded portion of the ticket substrate acts to cover at least part of the first game play area to allow first play with the game symbols of the first game play area including those subsequently covered and second play with symbols of the second game play area and excluding those of the first game play area which are covered.

The game can be of the type where the scratch-off is opaque and the game is played by exposing the symbols or where the scratch-off is translucent and the game is played by marking the symbols.

Preferably the movement of the second game play area causes rows or columns thereof to line up with rows or columns of the first game play area.

Preferably at least some of the symbols of said first game play area are arranged in a chain of related symbols extending on to the second game play area.

In one arrangement the tickets substrate includes a center panel and two wing panels which can fold inwardly onto the center panel, where the wing panels have the first game play area on the front surface thereof and the second game play area on the rear surface thereof.

In most cases the ticket has a single predetermined game prize and both first and second play areas contribute to the predetermined prize so that the ticket substrate carries a single validation number indicative of the single prize.

The game provided on each substrate sheet may be for prizes both monetary and product related or may be merely for entertainment where no gambling or prize is involved. The type and value of any prizes can vary widely. The games may be pre-determined, otherwise known as "instant win" tickets or may include elements of skill or chance. The games may include a scratch-off-coating which is convenient and effective particularly for instant win type game tickets, but other types of games which do not include scratch-off may be used.

The games concerned are preferably instant win type games where the result is entirely predetermined, since such games are generally preferred in a lottery situation in order to ensure that the total winnings is predetermined. However the present invention is not limited to the type of game to be played and can include probability or other games which include game indicia covered by a scratch-off coating.

The construction may also be used in situations where the main objective is for other purposes than gambling such as in promotional games or games of fun for children or others where no gambling or prizes are involved.

Many such tickets are used directly in a lottery situation so that the tickets have no other relevance other than the playing of the lottery or game by which the player may win monetary or other prizes as part of the lottery or gaming situation.

However more attention has been recently given to the use of such tickets as promotional items used by manufacturers of other products to enhance the sale of the product.

BRIEF DESCRIPTION OF THE DRAWINGS

One embodiment of the invention will now be described in conjunction with the accompanying drawings in which:

FIG. 3B is a front elevational view of the embodiment of a FIG. 3 showing the first wing panel folded inwardly to expose the game numbers printed on the rear and the second unfolded.

FIG. 3C is a front elevational view of the embodiment of a FIG. 3 showing the second wing panel folded inwardly to expose the game numbers printed on the rear and the first unfolded.

In the drawings like characters of reference indicate corresponding parts in the different figures.

DETAILED DESCRIPTION

Figure 1:
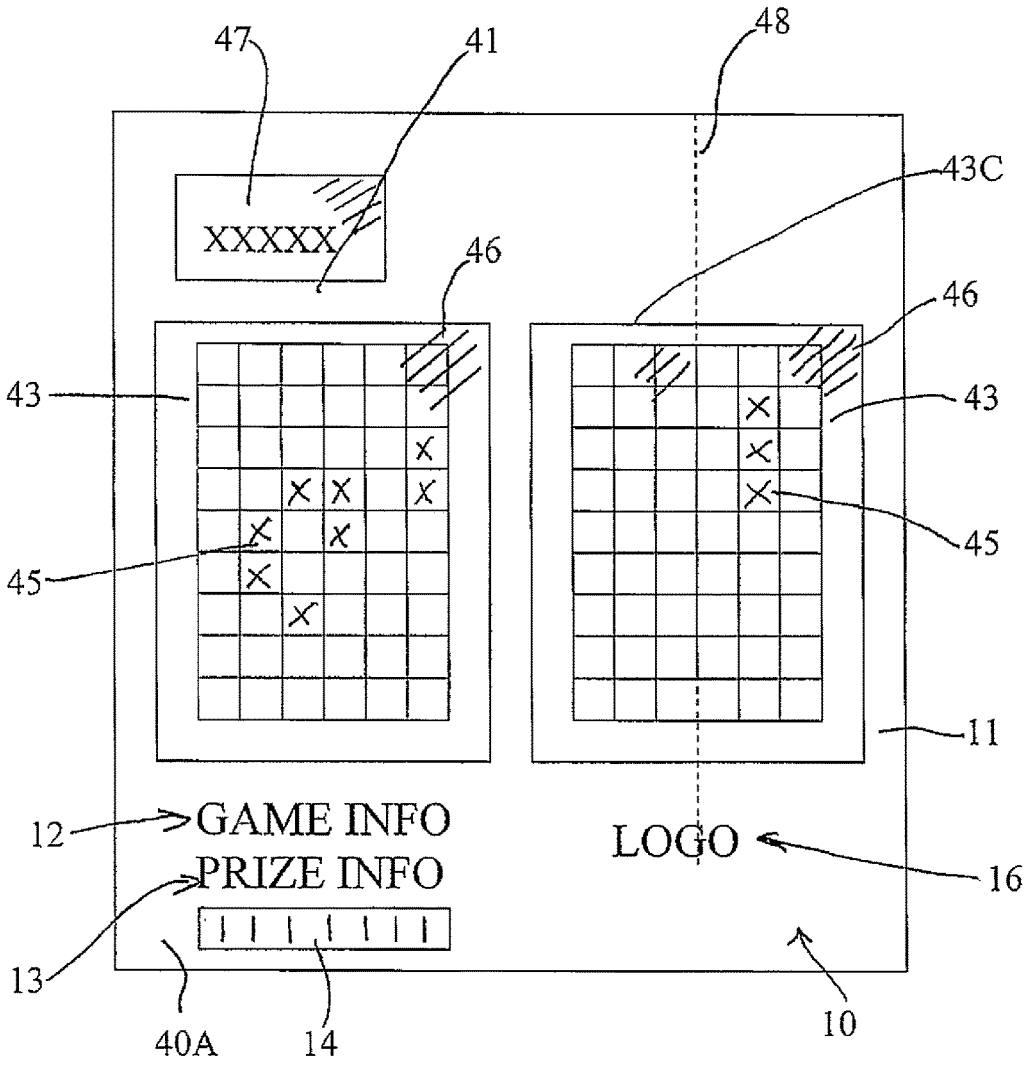
FIG. 1 is a front elevational view of one embodiment of a game ticket according to the present invention showing the ticket with a single foldable panel in an initial unfolded condition for first play.
Figure 2:
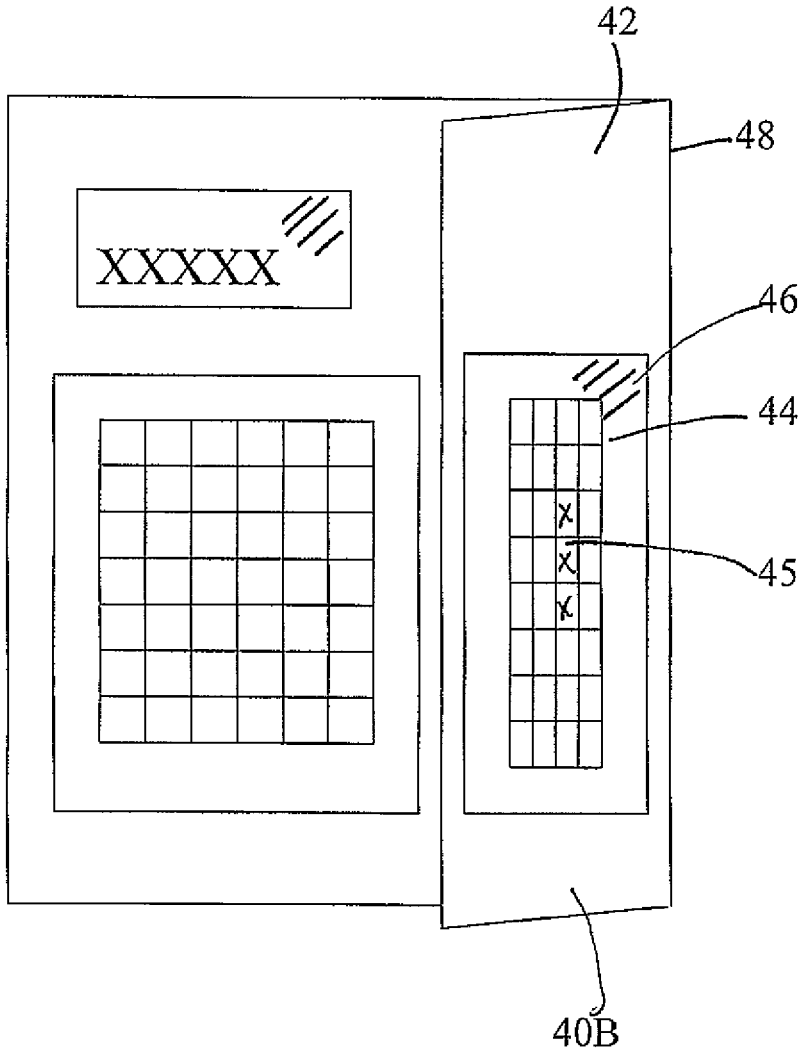
FIG. 2 is a front elevational view of the game ticket of FIG. 1 showing the ticket in a folded condition for second play.

In FIGS. 1 and 2 is shown a game ticket 10 defined by a ticket substrate 11 of a conventional construction and printed using conventional techniques well known to a person skilled in this industry. On the ticket is provided a game information area 12, a prize information area 13 and a validation number 14. The validation number 14 is typically, although not always, covered with a scratch-off layer 15 and is applied in the form of a machine readable bar code. A logo and other graphics 16 is applied at a suitable location on the front face of the substrate. The rear face is not shown as this contains conventional material not related to this game.

The game ticket 10 includes a first surface portion and a second surface portion of the substrate 11. A first game play area 43 is printed on the first surface portion 41 on a front surface of the ticket substrate. A second game play area 44 is printed on the second surface portion 42 of the ticket substrate. Each of the first and second game play areas 43, 44 containing game play symbols 45 printed on the game play area. Each of said first and second game play areas 43, 44 contains a scratch-off material 46 covering at least a part of the game play area which can be removed by the player for playing of the game by the player. The substrate has game play information or instructions 47 printed on the substrate. The first game play area 43 is arranged relative to said game play information 47 to allow playing by the player of the game symbols 45 on the first play area 43. The ticket substrate 40 is arranged to provide movement of the second game play area 44 relative to the game play information 47 to allow playing by the player of the game symbols 45 on the second play area 44.

In FIGS. 1 and 2, the second game play area 44 is moved by folding a wing portion of the ticket substrate 40 at fold line 48. The second game play area 44 is provided on the second or rear surface 42 which is located on a rear 40B of the ticket substrate and is moved by folding of the ticket substrate about the vertical perforation or fold line 48 to move the rear surface 42 to align with a portion of the front surface 40A.

Figure 5:
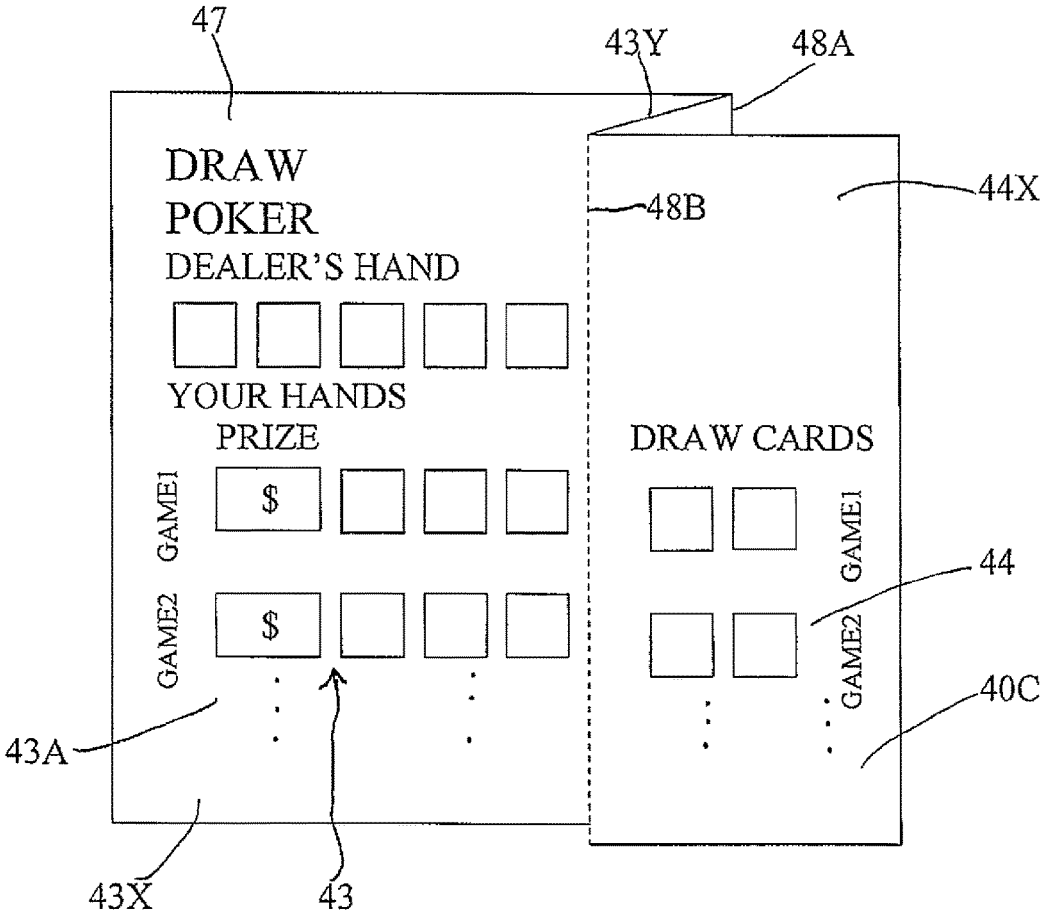
FIG. 5 is an isometric view of a further embodiment of a game ticket according to the present invention showing the ticket moving to a folded condition for second play.
Figure 6:
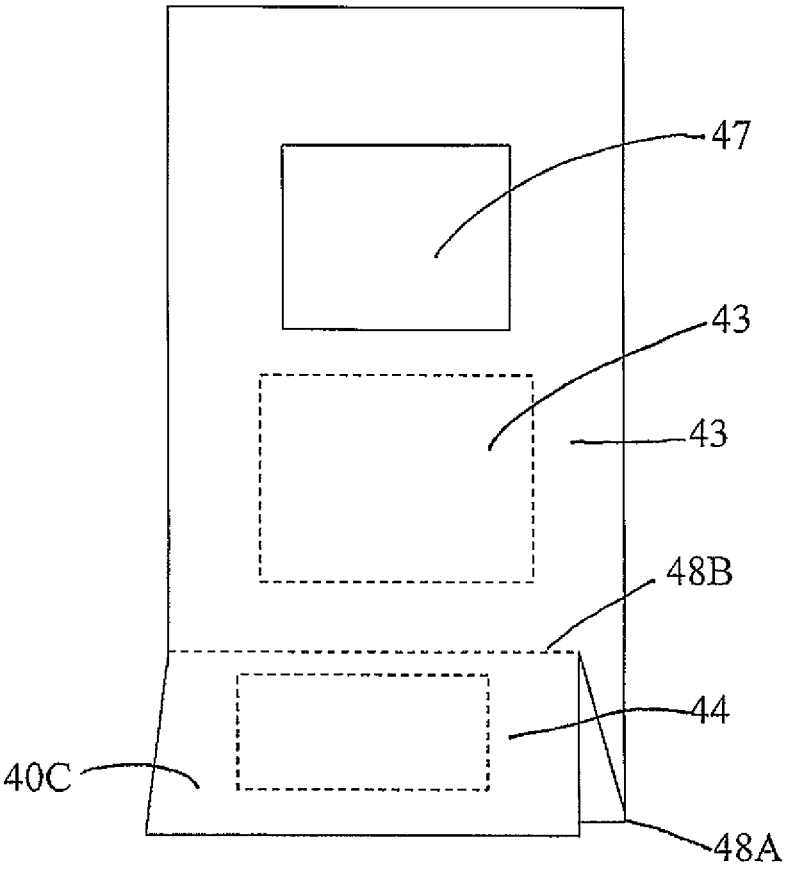
FIG. 6 is an isometric view of a further embodiment of a game ticket according to the present invention showing the ticket moving to a folded condition for second play.

In FIGS. 5 and 6, the second game play area 44 is located on a portion 40C of the front surface and is moved by folding of the ticket substrate about accordion fold lines 48A and 48B to move the second game play area 44 to align with a portion of the front surface. In this way, the second game play area 44 is moved to lie along side at least part 43A of the first game play area 43. The second game play area 44 is also moved to lie along side at least part of the game information 47 so that the player has access to both to play the second part of the game on the game area 44 after playing a first part of the game using the game data on the game area 43.

In FIG. 5, the fold lines 48A and 48B are longitudinal of the ticket so that the second game area 44 is along one side edge of the ticket. This is suitable where the tickets are dispensed individually.

In FIG. 6, the fold lines 48A and 48B are transverse to the ticket so that the second game area 44 is at one end of the ticket. This is suitable where the tickets are formed into a fan folded stack of a continuous strip so as to be dispensed by tearing each from the strip as they are forwarded from the stack.

As shown in FIGS. 1 and 2, the folded portion 42 of the ticket substrate acts to cover a part 43C of the first game play area to allow first play with the game symbols 45 of the first game play area 43 including those of the area 43C which are subsequently covered and second play with symbols 45 of the second game play area 44 and excluding those 43C of the first game play area 43 which are covered.

The game can be of the type where the scratch-off is opaque and the game is played by exposing the symbols or it can be of the type where the scratch-off is translucent and the game is played by marking the symbols.

As shown in FIGS. 1 and 2, the movement of the second game play area causes rows or columns thereof to line up with rows or columns of the first game play area.

In FIGS. 1 and 2 at least some of the symbols of the first game play area are arranged in a chain of related symbols extending from the first play area 43 on to the second game play area 44.

Figure 3:
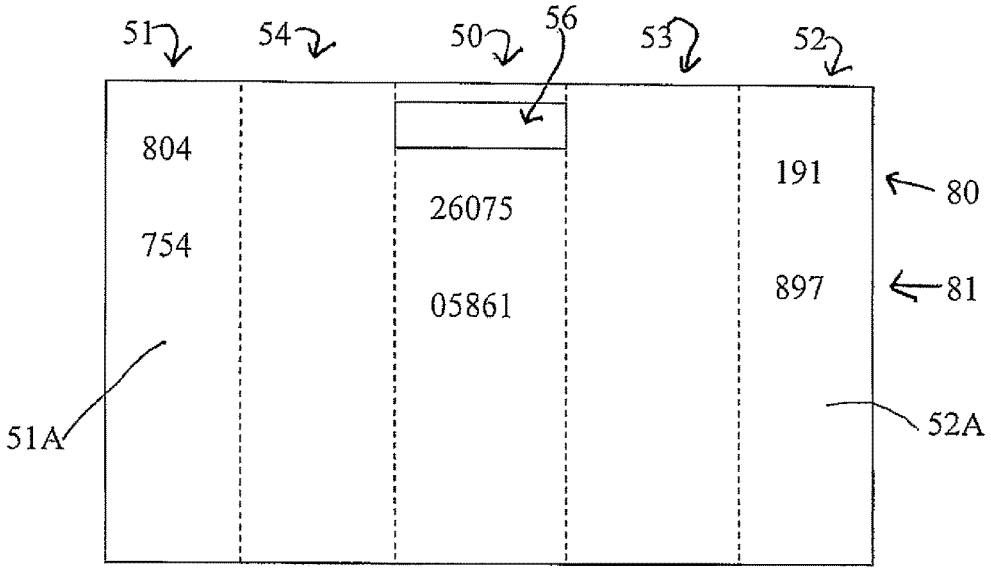
FIG. 3 is a front elevational view of a second embodiment of a game ticket according to the present invention showing the ticket with two opposed foldable panels in an initial unfolded condition for first play.

In FIG. 3, the ticket substrate is generally rectangular and includes a center panel 50 and two wing panels 51 and 52 which can fold inwardly about vertical fold lines 55 onto the center panel 50, where the wing panels 51 and 52 have the first game play area 53, 54 on the front surface thereof and the second game play area on the rear surface thereof.

Thus the wing panels 51 and 52 include first game play symbols on the front 51A, 52A and second game play symbols on the rear 51B, 52B. All are covered by an opaque scratch-off which can be removed to expose the symbols for play.

The center panel 50 also includes game play information 56 including instructions and data necessary to play the games.

In this arrangement in which the ticket include a center panel and two wing panels which can be folded over to display a further set of panels on each side of the ticket can be provided a game play format in which the play symbols on the front or back of folded side panels can be used independently in conjunction with the middle panel to complete a game. For example a game of "Find three Matching Numbers out of eleven within a Horizontal Row".

Figure 3A:
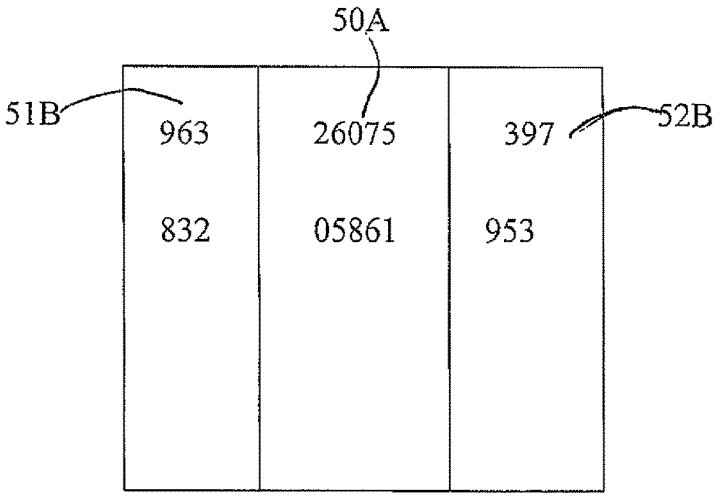
FIG. 3A is a front elevational view of the embodiment of a FIG. 3 showing the wing panels both folded inwardly to expose the game numbers printed on the rear.

On the ticket the numbers are printed as shown in FIGS. 3 and 3A.

In the first row 80 there is no combination of panels which would give a set of 3 matching numbers all being displayed at the same time as a result of folding 0, 1 or 2 panels over.

In the second row 81 there is a set of three matching 8's which are achieved by folding the left hand panel 51 over and leaving the right hand panel unfolded as shown in FIG. 3C. The resulting string of numbers is therefore "832 05861 897".

There can also be the possibility of having multiple sets of matching numbers as can be seen in the second row 81 when, as shown in FIG. 3B the left hand panel is unfolded and the right hand is folded. The resulting number string is "754 05861 953".

The other two non-winning combination of fold/non-fold would provide the number strings 832 05861 953 and 754 05861 897.

Thus the first game play area defined by the front surface of the ticket of FIG. 3 is arranged relative to the game play information 56 to allow playing by the player of the first game symbols 57 on the first play areas 51A, 52A by removing the scratch-off material on the game symbols.

The ticket substrate is arranged to provide movement of the second game play area on the rear of the wings 51 and 52 relative to said game play information 56 and first game play area 51A, 52A.

In the first position of the wings, the second game play symbols 51B, 52B are separated (turned to the rear) from the game play information 56 and the first game symbols 51A, 52A for playing of the first game symbols 51A, 52A in a first game part.

In the second position of the wings the second game play area 51B, 52B and the second game play symbols thereon are moved to be juxtaposition with the first game play area by turning inwards.

In the second juxtaposed position, the game play information 56 and the second game play symbols 51B, 52B are viewable as shown in FIG. 3 for playing by removing the scratch-off material thereon in a second game part.

In FIGS. 3 and 3A it will be noted that in the second game part, the second game play symbols 51A, 52A are provided in addition to at least some of the first game play symbols 50A on the first surface.

In FIGS. 3 and 3A it will be noted that in the second game part, the second game play symbols 51B, 52B are provided as a replacement for some of the first game play symbols, that is the symbols 51A and 52A which are now covered.

Thus a first portion of the ticket substrate acts to cover a first part of the first game play area and a second portion of the ticket substrate acts to cover a second part of the first game play area where the first and second parts can be moved between covering and non-covering positions to allow four different play combinations.

Figure 4:
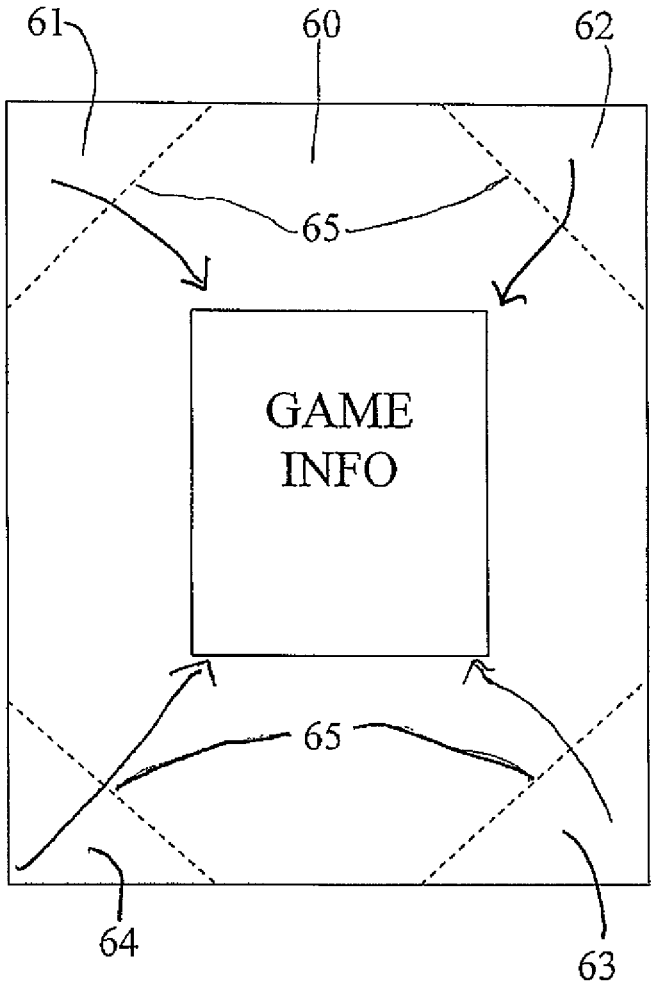
FIG. 4 is a front elevational view of a further embodiment of a game ticket according to the present invention showing the ticket with four foldable panels in an initial unfolded condition for first play.

In FIG. 4, the ticket substrate includes a center panel 60 and four corner panels 61 to 64 which can fold inwardly about fold lines 65 onto the center panel 50, where the corner panels have the first game play area on the front surface and the second game play area on the rear surface.

This concept therefore involves a physical fold of the ticket to extend the play. In the first arrangements of FIGS. 5 and 6 all of the play indicia are printed on one side of the ticket which is the front surface. The player initially plays the first two panels 43X and 43Y, beginning on the left hand side, with the first panel 43X being wider than the second panel 43Y. Once the play on these panels is finished, the player then folds the third play area 44 on the panel 44X over the second panel 43Y, in a V or accordion fold so that it "lands" on the side of panel 43X. The play on the third panel 44X has game data which is directly related to the game on the first panel 43X and provides for an extension of that game.

One example is the Poker game as shown in FIG. 5 where the panel 44X provides additional draw cards for the player to play with the hands shown in panel 43X. Another example is an extension of a Crossword game where the game unfolded shows "CROSS" "HOUSE" "WORD" and when folded shows "CROSSWORD".

The ticket of FIG. 3 is designed for an extension of play which is achieved by folding the ticket along the score lines 55. By example, the arrangement can use the terms SLOTS, SLOTS, MORE SLOTS on the ticket. In this case the player plays the games shown on the first side of the ticket. Once this play action is complete the two side panels are folded in to align with the prize values printed down the middle and play can continue utilizing games which are printed on the reverse side of the ticket on the rear of the panels 51 and 52.

The example shown features vertical score lines 55, to facilitate folding however the folds could be done in various directions, that is horizontal, vertical or diagonal.

For example as shown in FIG. 4 a square ticket includes a game on the front and additional play data on the back. Once the initial play is complete the four corners of the ticket are folded over to bring the four areas 61, 62, 53 and 64 on the back with the additional play data into position with the exposed game data on the front so that an extension of play can be achieved.

Figure 7:
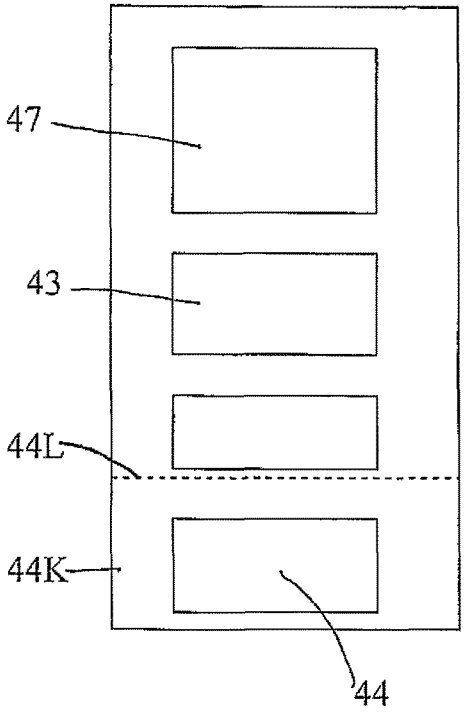
FIGS. 7 and 8 show a front elevational view of a further embodiment of a game ticket according to the present invention showing an arrangement in which a portion of the substrate is removed and moved.
Figure 8:
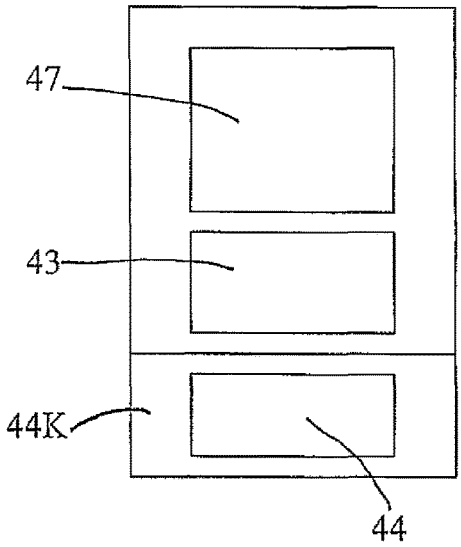

It will be appreciated that in all of the tickets described, the ticket is of an instant win format where the ticket has a single predetermined game prize and both first and second play areas contribute to the predetermined prize. Thus in most cases the ticket substrate carries a single validation number 14 indicative of the single prize. All of the game parts therefore are in effect part of the same game with a single allocated prize with the separate game parts providing an extended play concept for the player In FIGS. 7 and 8, the second game play area 44 is moved by removing one portion 44K of the ticket for example by tearing at a line 44L and physically placing that portion adjacent to the first play area 43. Thus the game play areas 43 and 44 are both on the front surface of the ticket and the portion remains with its front surface facing toward the player showing the second game area 44.

Thus the game symbols on the second play area 44 are moved to a position where they are adjacent to and associated with at least some of the game symbols 43 of the first game play area to provide additional play of the combination of the game symbols on the second play area in association with some of the game symbols on the first play area.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for playing a game on a game ticket comprising:

forming a game ticket by:

supplying a ticket substrate having a front surface and a rear surface;

defining a first surface portion on the front surface and a second surface portion on the rear surface;

printing a first game play area on the first surface portion on the front surface of the ticket substrate;

printing a second game play area on the second surface portion on the rear surface of the ticket substrate;

printing on said first game play area first game play symbols;

printing on said second game play area second game play symbols;

applying on each of said first and second game play areas a scratch-off material covering at least a part of each of the first and second game play areas and at least some of the first and second game play symbols thereon;

printing game play information related to said game on the front surface of the substrate;

arranging the second game play area printed on the second surface portion on the rear surface of the ticket substrate such that the ticket substrate can be folded about a fold line across the ticket substrate from a first position in which the second game play area is on the rear of the substrate separated from the first game play area to a second juxtaposed position in which the second game play area and the second game play symbols are moved to bring the second game play area into a juxtaposed position with the first game play area and the game play information;

supplying the game ticket to a player;

the player, when the second game play area is in the first position separated from the first game play area, playing a first game part of the game by removing the scratch-off material on the first game play area using the first game symbols and said game play information;

the player folding the ticket substrate from the first position to the second juxtaposed position;

the player, when the ticket substrate is in the juxtaposed position, playing a second game part of the game by removing the scratch-off material on the second game play area using the second game play symbols and said game play information.

2. The method according to claim 1 wherein, when playing the second game part, the second game play symbols are used in addition to at least some of the first game play symbols.

3. The method according to claim 1 wherein, when playing the second game part, the second game play symbols replace some of the first game play symbols.

4. The method according to claim 1 wherein the second game symbols on the second play area are moved in the second juxtaposed position to where the second game symbols are adjacent to and associated with at least some of the first game symbols of the first game play area to provide additional play of the game by a combination of the second game symbols on the second play area in association with some of the first game symbols on the first play area.

5. The method according to claim 1 wherein the second game play area is moved to lie alongside at least part of the first game play area.

6. The method according to claim 1 wherein the second game play area is moved to lie alongside at least part of the game play information.

7. The method according to claim 1 wherein a portion of the ticket substrate acts to cover at least part of the first game play area to allow first play with the first game symbols of the first game play area including the first game symbols subsequently covered and second play with second game play symbols of the second game play area and excluding the first game play symbols of the first game play area which are covered.

8. The method according to claim 1 wherein a first portion of the ticket substrate acts to cover a first part of the first game play area and a second portion of the ticket substrate acts to cover a second part of the first game play area where the first and second parts can be moved between covering and non-covering positions to allow four different play combinations.

9. The method according to claim 1 wherein the scratch-off is opaque and the first and second game parts are played by exposing the game play symbols.

10. The method according to claim 1 wherein the scratch-off is translucent and the first and second game parts are played by marking the first and second game play symbols.

11. The method according to claim 1 wherein there ticket has a single predetermined game prize which is dependent upon both said first game play part and said second game play part.

12. The method according to claim 11 wherein the ticket substrate carries a single validation number indicative of the single prize.

13. A method for playing a game on a game ticket comprising:

forming a game ticket by:

supplying a ticket substrate having a front surface and a rear surface;

defining a first surface portion on the front surface and defining a second surface portion on the front surface;

printing a first game play area on the first surface portion on the front surface of the ticket substrate;

printing a second game play area on the second surface portion on the front surface of the ticket substrate;

printing on said first game play area first game play symbols;

printing on said second game play area second game play symbols;

applying on each of said first and second game play areas a scratch-off material covering at least a part of each of the first and second game play areas and at least some of the first and second game play symbols thereon;

printing game play information related to said game on the front surface of the substrate;

the second game play area being printed on the second surface portion on the front surface of the ticket substrate so as to be separated by a space from the first game play area printed on the first surface portion on the front surface of the ticket substrate;

supplying the game ticket to a player;

the player, when the second game play area is separated from the first game play area by the space, playing a first game part of the game by removing the scratch-off material on the first game play area using the first game symbols and said game play information;

the player folding the ticket substrate with first and second spaced folds at the space arranged such that the ticket substrate is folded by an accordion fold in the space to a position in which the second game play area and the second game play symbols on the front surface of the substrate are moved to bring the second game play area into a juxtaposed position with the first game play area and the game play information;

the player, when the ticket substrate is in the juxtaposed position, playing a second game part of the game by removing the scratch-off material on the second game play area using the second game play symbols and said game play information.

14. The method according to claim 13 wherein, when playing the second game part, the second game play symbols are used in addition to at least some of the first game play symbols.

15. The method according to claim 13 wherein, when playing the second game part, the second game play symbols replace some of the first game play symbols.

16. The method according to claim 13 wherein the first game play area includes first rows and columns and the second game play area includes second rows and columns and in the juxtaposed position the first rows and columns line up with the second rows and columns.

17. The method according to claim 13 wherein in the juxtaposed position at least some of the game play symbols of said first game play area are arranged in a chain of related game play symbols extending on to the second game play area.

18. The method according to claim 13 wherein the second game symbols on the second play area are moved in the second juxtaposed position to where the second game symbols are adjacent to and associated with at least some of the first game symbols of the first game play area to provide additional play of the game by a combination of the second game symbols on the second play area in association with some of the first game symbols on the first play area.

19. The method according to claim 13 wherein a portion of the ticket substrate acts to cover at least part of the first game play area to allow first play with the first game symbols of the first game play area including the first game symbols subsequently covered and second play with second game play symbols of the second game play area and excluding the first game play symbols of the first game play area which are covered.

20. The method according to claim 13 wherein a first portion of the ticket substrate acts to cover a first part of the first game play area and a second portion of the ticket substrate acts to cover a second part of the first game play area where the first and second parts can be moved between covering and non-covering positions to allow four different play combinations.

21. The method according to claim 13 wherein the scratch-off is opaque and the first and second game parts are played by exposing the first and second game play symbols.

22. The method according to claim 13 wherein the scratch-off is translucent and the first and second game parts are played by marking the first and second game play symbols.

23. The method according to claim 13 wherein there ticket has a single predetermined game prize which is dependent upon both said first and second game play parts.

24. The method according to claim 23 wherein the ticket substrate carries a single validation number indicative of the single prize.

* * * * *